US008746193B2

(12) United States Patent
Bowler et al.

(10) Patent No.: US 8,746,193 B2
(45) Date of Patent: Jun. 10, 2014

(54) CONTROL OF ENGINE WITH ACTIVE FUEL MANAGEMENT

(75) Inventors: Alan Edgar Bowler, Oxford, MI (US); Robert Lionel Jacques, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 310 days.

(21) Appl. No.: 13/363,805

(22) Filed: Feb. 1, 2012

(65) Prior Publication Data

US 2013/0192547 A1 Aug. 1, 2013

(51) Int. Cl.
*F01L 9/02* (2006.01)

(52) U.S. Cl.
USPC ..... 123/90.13; 123/41.35

(58) Field of Classification Search
CPC ..... F01P 3/06
USPC ..... 123/90.38, 196 R, 196 M, 198 F, 90.12, 123/90.13, 41.35, 41.34, 196 AB
See application file for complete search history.

(56) References Cited

U.S. PATENT DOCUMENTS

| | | | | |
|---|---|---|---|---|
| 7,426,912 | B2 * | 9/2008 | Lee | 123/90.12 |
| 2011/0283968 | A1 * | 11/2011 | Anderson et al. | 123/196 R |
| 2012/0132172 | A1 * | 5/2012 | Kobayashi et al. | 123/196 R |
| 2013/0019834 | A1 * | 1/2013 | Hazelton | 123/196 R |

* cited by examiner

*Primary Examiner* — Thomas Denion
*Assistant Examiner* — Daniel Bernstein
(74) *Attorney, Agent, or Firm* — Quinn Law Group, PLLC

(57) ABSTRACT

An engine includes a fluid pump configured to pressurize oil and a cylinder configured to combust a mixture of fuel and air therein. The engine also includes a valve arrangement configured to deliver air or fuel and air mixture to and exhaust post-combustion gases from the cylinder. The engine additionally includes fluidly connected first and second switching mechanisms, and an oil gallery fluidly connecting the fluid pump and the second switching mechanism. The engine additionally includes an oil squirter in fluid communication with the second switching mechanism and configured to spray the pressurized oil into the cylinder. The second switching mechanism is operated by the pressurized oil to selectively activate and deactivate operation of the valve arrangement. Moreover, the first switching mechanism is configured to alternately direct the pressurized oil to the second switching mechanism to deactivate the operation of the valve arrangement and to feed the oil squirter.

20 Claims, 4 Drawing Sheets

CONTROL OF ENGINE WITH ACTIVE FUEL MANAGEMENT

TECHNICAL FIELD

The present disclosure relates to control of an internal combustion engine equipped with active fuel management.

BACKGROUND

Some internal combustion (IC) engines, such as those used in motor vehicles, employ selective deactivation of valves for specific engine cylinder(s), often called active fuel management, in order to reduce the engine's fuel consumption when full engine power and torque are not required.

Under extreme operating conditions, and as a by-product of power generation, IC engines typically generate elevated amounts of heat energy within their combustion chambers. Such heat energy may in turn cause significant thermal stresses. In order to reduce such thermal stresses, IC engines are generally cooled in order to maintain their operating temperature in a particular range and ensure the engine's efficient and reliable performance. In a majority of motor vehicles, IC engines are cooled by a circulating fluid, such as a specially formulated chemical compound mixed with water. Additionally, such engines are lubricated and cooled by oils that are generally derived from petroleum-based and non-petroleum synthesized chemical compounds.

The generated heat energy usually affects the entire engine structure, but is initially absorbed by the engine's pistons. Accordingly, for enhanced durability, IC engines, such as those equipped with active fuel management, may additionally employ piston squirters or oil jets to cool the pistons and permit the engine to reliably withstand elevated thermal stresses.

SUMMARY

An internal combustion engine includes a fluid pump configured to pressurize oil and an engine cylinder configured to combust a mixture of fuel and air therein. The engine also includes a valve arrangement configured to deliver air or the mixture of fuel and air to, and exhaust post-combustion gases from, the cylinder. The engine additionally includes a first switching mechanism and a second switching mechanism in fluid communication with each other, and an oil gallery fluidly connecting the fluid pump and the second switching mechanism.

The engine additionally includes an oil squirter in fluid communication with the second switching mechanism and configured to spray the pressurized oil into the cylinder. The second switching mechanism is operated by the pressurized oil to selectively activate and deactivate operation of the valve arrangement. Moreover, the first switching mechanism is configured to alternately direct the pressurized oil to the second switching mechanism to deactivate the operation of the valve arrangement and to feed the oil squirter.

The second switching mechanism may be configured as a collapsible lifter. In the alternative, the second switching mechanism may also be configured as a lockable rocker-arm arrangement.

The first switching mechanism may be configured as a solenoid oil-control valve.

Operation of the first switching mechanism may be regulated by a controller. The controller may also regulate the mixture of fuel and air delivered to the cylinder when the first switching mechanism directs the pressurized oil to the oil squirter. Furthermore, the controller may cease delivery of the mixture of fuel and air to the cylinder when the first switching mechanism directs the pressurized oil to the second switching mechanism.

The cylinder may be defined by a cylinder bore and the cylinder may include a piston configured to reciprocate inside the cylinder bore. In such case, the oil squirter may be configured to spray the pressurized oil onto at least one of the cylinder bore and the underside of the piston.

A vehicle having such an engine and a method of controlling operation of such an engine are also disclosed.

The above features and advantages, and other features and advantages of the present disclosure, will be readily apparent from the following detailed description of the embodiment(s) and best mode(s) for carrying out the described invention when taken in connection with the accompanying drawings and appended claims.

DETAILED DESCRIPTION

Figure 1:
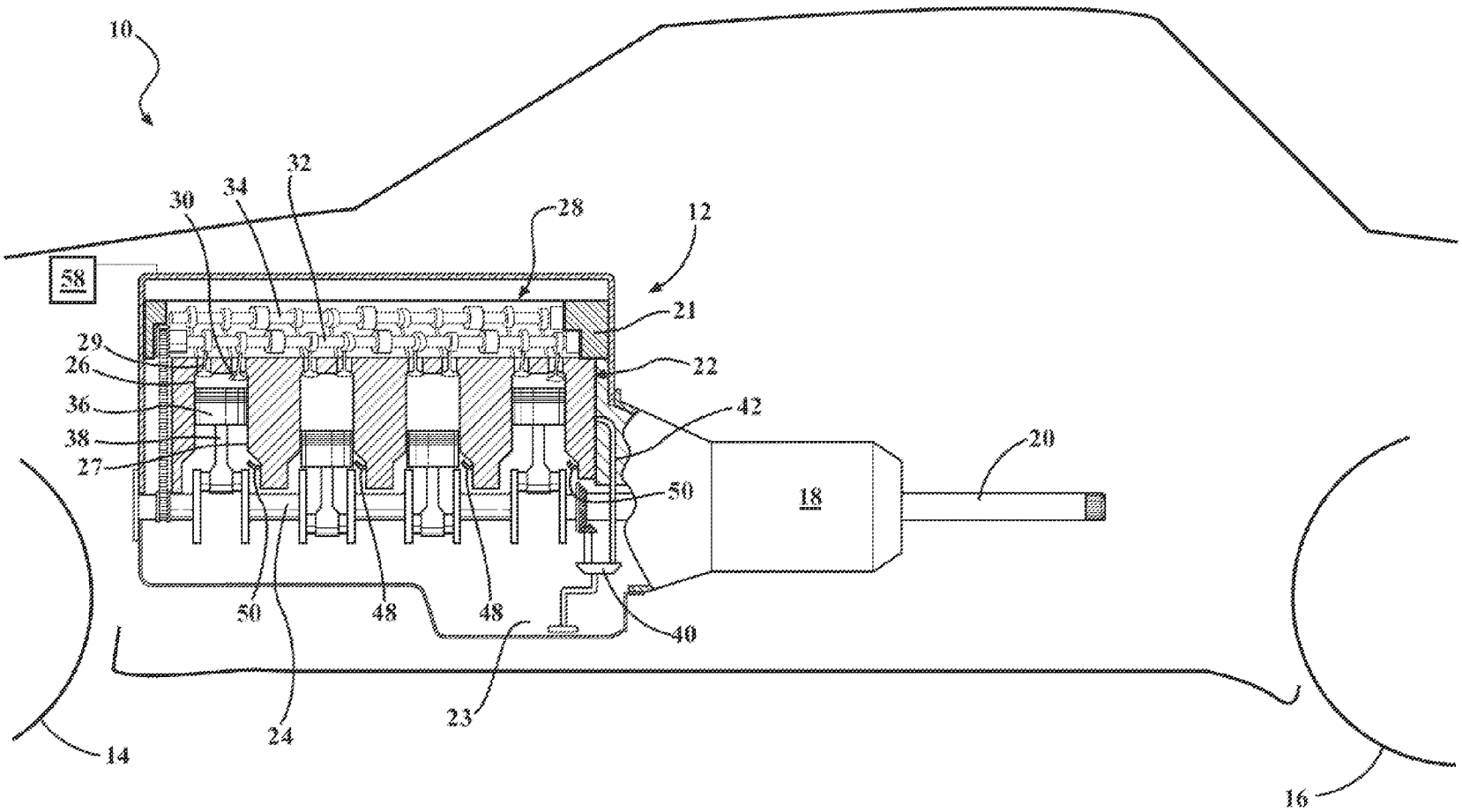
FIG. 1 is a schematic illustration of a motor vehicle having an internal combustion engine that employs active fuel management valve deactivation and cylinder oil squirters.

Referring to the drawings, wherein like reference numbers refer to like components, FIG. 1 shows a schematic view of a motor vehicle 10. The vehicle 10 incorporates a powertrain that includes an internal combustion (IC) engine 12, such as a spark or a compression ignition type, adapted for driving wheels 14 and/or wheels 16 to propel the vehicle. The engine 12 applies its torque to the driven wheels 14 and/or 16 through a transmission 18 and via a drive or a propeller shaft 20. The engine 12 includes a cylinder head 21, a cylinder block 22, and an oil pan or sump 23.

The sump 23 is attached to the cylinder block 22 for holding a body of oil. The cylinder block 22 houses a crankshaft 24 and cylinders 26. Each cylinder 26 is defined by a cylinder bore 27. The cylinders 26 are also provided with a valve arrangement 28 configured to deliver a mixture of fuel and air to, and exhaust post-combustion gases from, the cylinders. The valve arrangement 28 includes intake valves 29 and exhaust valves 30 that may be actuated by respective intake and exhaust camshafts 32, 34, as shown in FIG. 1. The intake and exhaust valves 29, 30 are positioned inside the cylinder head 21. The intake and exhaust camshafts 32, 34 may be rotatably mounted on or inside a cylinder head 21. Although separate intake and exhaust camshafts 32, 34 are shown, such as commonly used in overhead-cam type of engines, a single camshaft may be employed and rotatably mounted inside the cylinder block 22, such as in an overhead-valve type of engine, to actuate the intake and exhaust valves 29, 30.

The intake valves 29 are configured to control a supply of air or of air and fuel into the respective cylinder 26, while the exhaust valves 30 are configured to control the removal of post-combustion exhaust gas from the respective cylinder. Each cylinder 26 also includes a piston 36 and a connecting rod 38. The pistons 36 are configured to reciprocate under the force of combustion inside their respective cylinder bores 27, and thereby rotate the crankshaft 24 via the connecting rods 38. Accordingly, rotation imparted onto the crankshaft 24 by one of the pistons 36 via its respective connecting rod 38 results in reciprocating motion of the remaining connecting rods and pistons associated with the other cylinders.

The crankshaft 24, camshafts 32, 34, connecting rods 38 and various other rotating or otherwise frequently moving components of the engine 12 are supported by specifically configured bearings (not shown). Typically, such bearings rely on a film of oil established between a surface of the bearing and the supported component to create a reliable low friction interface. Typically, the oil used in internal combustion engines is a specially formulated fluid that is derived from petroleum-based and non-petroleum chemical compounds. Such oil is mainly blended by using base oil composed of hydrocarbons and other chemical additives for a specific engine application.

The engine 12 also includes a fluid pump 40 configured to draw oil from the sump 23, and then pressurize and supply the oil to a main oil gallery 42. The main oil gallery 42, in turn, distributes the pressurized oil to the engine bearings of the crankshaft 24, camshafts 32, 34, connecting rods 38, and to other components that rely on the oil for lubrication, actuation, and/or cooling. Because the engine 12 requires a greater pressure and volume of oil at higher engine speeds and combustion pressures, the pump 40 is configured to generate a progressive increase in the amount of oil pressure as the speed of the engine 12 rises. The pump 40 may be driven mechanically by the engine 12, such as by the one of the camshafts 32, 34 or the crankshaft 24, or be operated electrically.

Figure 2:
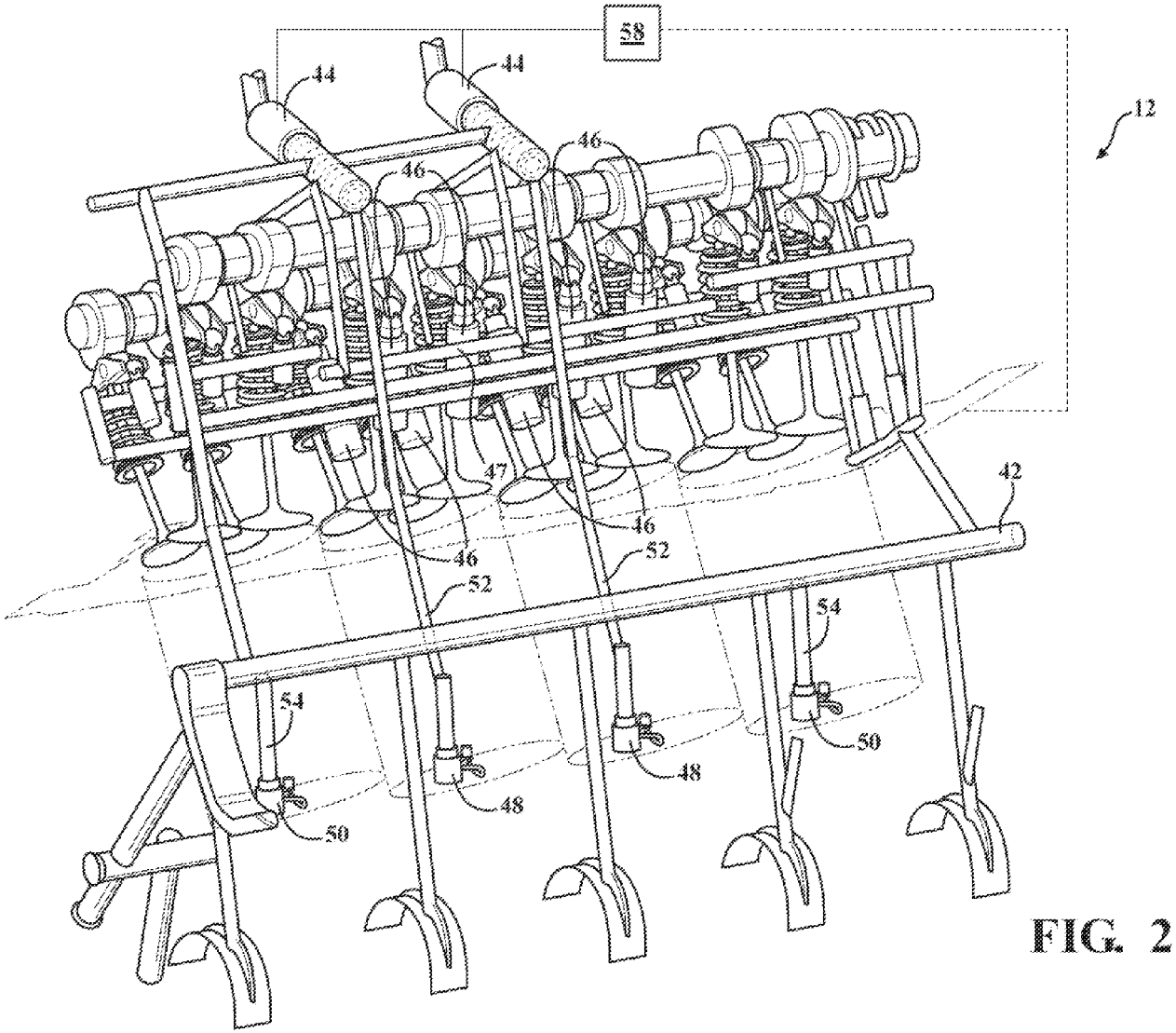
FIG. 2 is a schematic illustration of internal oil passages and switching mechanisms for actuation of active fuel management and feeding cylinder oil squirters shown in FIG. 1, wherein the active fuel management employs collapsible lifters.

As shown in FIG. 2, the valve arrangement 28 is configured to affect active fuel management, a.k.a., variable displacement or selective cylinder deactivation, to control combustion of fuel and air mixture in specific cylinders 26. Active fuel management is an engine technology that allows effective engine displacement to change by deactivating operation, i.e., power production, of specific cylinders of the subject engine for improved fuel economy. In order to affect the active fuel management, the engine 12 also includes a first switching mechanism 44 and a second switching mechanism 46. The main oil gallery 42 fluidly connects the pump 40 and the second switching mechanism 46. The second switching mechanism 46 is operated by the pressurized oil via the main oil gallery 42 to selectively activate and deactivate operation of the valve arrangement 28. Accordingly, when specific valves 29, 30 of the valve arrangement 28 are thus deactivated, air or the mixture of fuel and air is ceased to be delivered to and post-combustion gases are ceased to be exhausted from the subject cylinder 26. The first switching mechanism 44 and the second switching mechanism 46 are in fluid communication with each other via a fluid passage 47.

Figure 3:
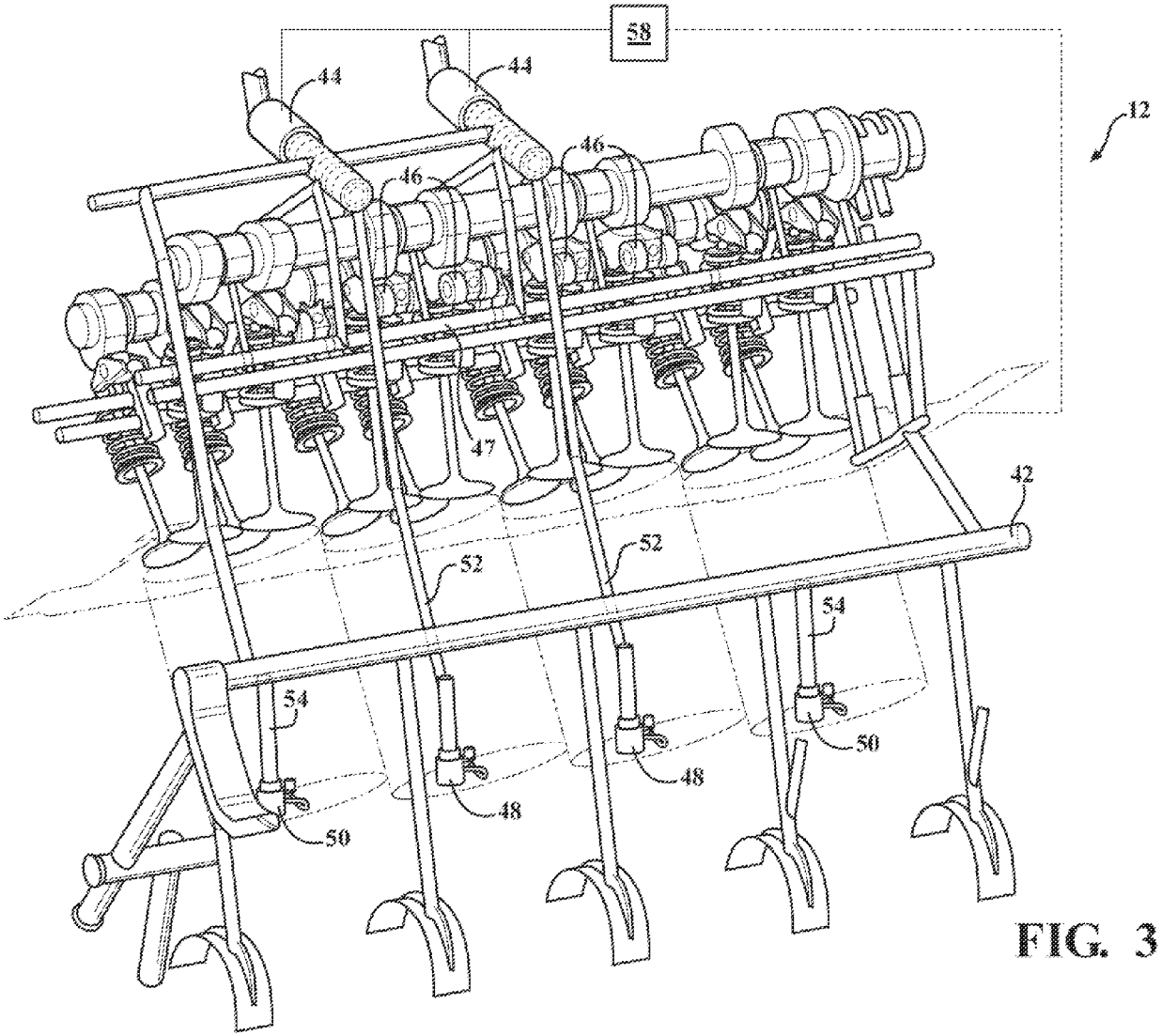
FIG. 3 is a schematic illustration of internal oil passages and switching mechanisms for actuation of active fuel management and feeding cylinder oil squirters shown in FIG. 1, wherein the active fuel management employs a lockable rocker-arm arrangement.

As shown in FIG. 2, the second switching mechanism 46 may be configured as a collapsible lifter. A collapsible lifter is configured to disable and re-enable operation of the respective intake valve 29 or exhaust valve 30 to deactivate and reactivate power production from the respective engine cylinder 26. On the other hand, the second switching mechanism 46 may also be configured as a lockable rocker-arm arrangement, as shown in FIG. 3. Similar to the collapsible lifter, the lockable rocker-arm arrangement disables and re-enables operation of the intake and exhaust valves 29, 30 to deactivate and reactivate power production from the respective engine cylinder 26. The specific configuration of the second switching mechanism 46 may be selected based at least in part on whether the engine is overhead-cam or overhead-valve type. The lockable rocker-arm arrangement of FIG. 2 is more likely to be adapted to an overhead-cam engine, while the collapsible lifter of FIG. 3 is more likely to be employed on an overhead-valve engine.

In order to deactivate a specific cylinder 26, the exhaust valve 30 may be prevented from opening after the piston's power stroke and the post-combustion exhaust gas is retained in the cylinder and compressed during the piston's exhaust stroke. Following the piston's exhaust stroke, the intake valve 29 is prevented from opening. Accordingly, the repeatedly expanded and compressed post-combustion exhaust gas acts like a gas spring inside the cylinder 26. Multiple cylinders may be shut off at the same time in multi-cylinder engines. In general, as multiple cylinders are shut off at a time, the power required for compression of the exhaust gas in one cylinder is countered by the decompression of retained exhaust gas in another. When more power is requested, an exhaust valve is reactivated and the previously unreleased exhaust gas is expelled during the exhaust stroke of the particular piston. Subsequently, an attendant intake valve is likewise reactivated and normal engine operation is resumed. The net effect of such cylinder deactivation is an improvement in fuel economy in the subject engine, as well as a concomitant reduction in exhaust emissions.

As shown in FIGS. 1 and 2, the engine additionally employs oil squirters 48 and 50, wherein each of the oil squirters 48, 50 is configured to spray the pressurized oil into the respective engine cylinder 26. While each of the oil squirters 48 services a specific cylinder 26 that may be deactivated by active fuel management, each of the oil squirters 50 is associated with a specific cylinder 26 that is not equipped to be deactivated. Each of the oil squirters 48, 50 is positioned at each respective cylinder 26 underneath a respective piston 36 for supplying a jet of oil to the underside of the piston and to the respective cylinder bore 27. Accordingly, each of the oil squirters 48, 50 may be configured to spray pressurized oil onto at least one of the respective cylinder bore 27 and the underside of the piston 36. The oil squirters 48, 50 are thereby employed to selectively reduce the thermal stress experienced by the pistons 36 as a result of combustion during operation of engine 10 and lubricate the cylinder bores 27 by generating a film of oil thereon. Although a single oil squirter 48 or 50 is shown at each cylinder 26 location, any quantity of oil squirters may be used at each cylinder in other possible embodiments. The oil pressure generated by the pump 40 is sufficient for each oil squirter 48, 50 to establish the jet of oil that targets the underside of the respective piston 36 and cylinder bore 27.

With resumed reference to FIGS. 2 and 3, the first switching mechanism 44 is configured to alternately direct the pressurized oil to the second switching mechanism 46 via an oil passage 52 to thereby deactivate the operation of the valve arrangement 28 and to feed the oil squirters 48. As shown in FIG. 2, the first switching mechanism 44 is configured as a solenoid oil-control valve that permits the pressurized fluid to flow either toward the second switching mechanism 46 or to the oil squirters 48. Each of the oil squirters 48 that service the cylinders 26 that may be deactivated by the second switching mechanism 46 is in direct fluid communication with the second switching mechanism via an oil passage 52. On the other hand, each of the oil squirters 50 associated with cylinders that are not equipped to be deactivated is in direct fluid communication with the main oil gallery 42 via an oil passage 54. Accordingly, while the oil passage 54 feeds oil squirters 50 the entire time when the pump 40 is operating, oil squirters 48 are only supplied with pressurized oil when the first switching mechanism 44 does not direct the pressurized oil to the second switching mechanism 46.

As additionally shown in FIGS. 2 and 3, a distinct first switching mechanism 44 may be used for each cylinder 26 that is configured to be deactivated in order to facilitate separate control over each subject cylinder's respective valves 29, 30. The individual control provided by the separate first switching mechanisms 44 may be used to generate a time gap between deactivation and/or re-activation of the individual cylinders 26. Furthermore, in such a case each first switching mechanism 44 is also configured to supply pressurized oil to a single oil squirter 48 while the pressurized oil is not being directed to the associated second switching mechanism 46.

The operation of the first switching mechanism 44 is regulated by a controller 58. The controller 58 may be a central processing unit (CPU), as shown in FIG. 1, or a dedicated controller arranged with respect to the engine 12 on the vehicle 10, as shown in FIG. 2. In the event that the controller 58 is configured as a CPU, the controller may additionally regulate the mixture of fuel and air delivered to the cylinders 26 when the first switching mechanism 44 directs the pressurized oil to the oil squirter 48. In such a case the controller 58 may additionally cease delivery of the mixture of fuel and air to the cylinders 26 when the first switching mechanism 44 directs the pressurized oil to the second switching mechanism 46.

Figure 4:
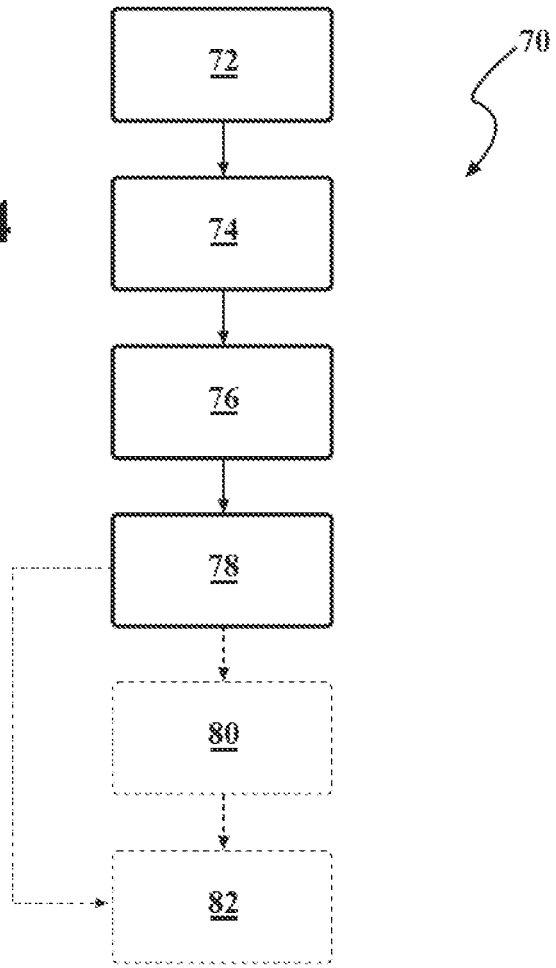
FIG. 4 is a flow chart illustrating a method of controlling operation of the engine illustrated in FIGS. 1-3.

A method 70 of controlling operation of the engine 12 in the vehicle 10 is shown in FIG. 4 and is described below with respect to FIGS. 1-3. In frame 72 the method provides pressurizing oil via the fluid pump 40 while the engine 12 is running From frame 72 the method proceeds to frame 74, where it includes operating the valve arrangement 28 to deliver a mixture of fuel and air to the cylinders 26 for combustion therein and exhaust post-combustion gases therefrom. As described above, the valve arrangement 28 is configured to selectively activate and deactivate particular intake and exhaust valves 29, 30 to affect active fuel management for controlling combustion inside specific cylinders 26. After frame 74 the method advances to frame 76.

In frame 76, the method includes directing via the first switching mechanism 44 at least a portion of the pressurized oil to feed the oil squirters 48 in order to spray the pressurized oil into the cylinder 26 while the mixture of fuel and air is being delivered to the cylinder. Following frame 76, the method proceeds to frame 78. In frame 78, the method includes directing via the first switching mechanism 44 the portion of the pressurized oil to the second switching mechanism 46 such that operation of the valve arrangement 28 is deactivated. Furthermore, in frame 78 the act of directing via the first switching mechanism 44 the pressurized oil to the second switching mechanism 46 is accomplished while ceasing to direct at least a portion of the pressurized oil to the oil squirters 48.

Following frame 78, the method may advance to frame 80, where the method may include regulating the mixture of fuel and air delivered to the cylinders 26 when the pressurized oil is directed to the oil squirters 48. Additionally, while regulating the fuel and air mixture, the method may include ceasing delivery of the fuel and air mixture to the cylinders 26 while the pressurized oil is being directed to the second switching mechanism 46. As described above with respect to FIGS. 1-3, the vehicle 10 includes a controller 58 that may direct the pressurized oil via the first switching mechanism 44, regulate the mixture of fuel and air being delivered to the specific cylinder 26, and cease delivery of the mixture of fuel and air to the particular cylinder. Following either frame 78 or 80, the method may direct the pressurized oil back to the oil squirter 48 while ceasing to direct the oil to the second switching mechanism 46 via the first switching mechanism 44 in frame 82.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. An internal combustion engine comprising:

a fluid pump configured to pressurize oil;

an engine cylinder configured to combust a mixture of fuel and air therein;

a valve arrangement configured to deliver at least one of the air and the mixture of fuel and air to, and exhaust post-combustion gases from, the engine cylinder;

a first switching mechanism and a second switching mechanism in fluid communication with each other;

an oil gallery fluidly connecting the fluid pump and the second switching mechanism; and an oil squirter in fluid communication with the second switching mechanism and configured to spray the pressurized oil into the engine cylinder;

wherein:

the second switching mechanism is operated by the pressurized oil to selectively activate and deactivate operation of the valve arrangement; and the first switching mechanism is configured to alternately direct the pressurized oil to the second switching mechanism to deactivate the operation of the valve arrangement and to feed the oil squirter.

2. The engine according to claim 1, wherein the second switching mechanism is configured as a collapsible lifter.

3. The engine according to claim 1, wherein the second switching mechanism is configured as a lockable rocker-arm arrangement.

4. The engine according to claim 1, wherein the first switching mechanism is configured as a solenoid oil-control valve.

5. The engine according to claim 1, wherein operation of the first switching mechanism is regulated by a controller.

6. The engine according to claim 5, wherein the controller additionally regulates the mixture of fuel and air delivered to the cylinder when the first switching mechanism directs the pressurized oil to the oil squirter, and ceases delivery of the mixture of fuel and air to the cylinder when the first switching mechanism directs the pressurized oil to the second switching mechanism.

7. The engine according to claim 1, wherein the cylinder is defined by a cylinder bore, the cylinder includes a piston configured to reciprocate inside the cylinder bore, and wherein the oil squirter is configured to spray the pressurized oil onto at least one of the cylinder bore and the underside of the piston.

8. A vehicle comprising:

an internal combustion engine configured to propel the vehicle, the engine including:

a fluid pump configured to pressurize oil;

an engine cylinder configured to combust a mixture of fuel and air therein and exhaust post-combustion gases therefrom;

a valve arrangement configured to deliver at least one of the air and the mixture of fuel and air to, and exhaust post-combustion gases from, the engine cylinder;

a first switching mechanism and a second switching mechanism in fluid communication with each other;

an oil gallery fluidly connecting the fluid pump and the second switching mechanism; and an oil squirter in fluid communication with the second switching mechanism and configured to spray the pressurized oil into the engine cylinder;

wherein:

the second switching mechanism is operated by the pressurized oil to selectively activate and deactivate operation of the valve arrangement; and the first switching mechanism is configured to alternately direct the pressurized oil to the second switching mechanism to deactivate the operation of the valve arrangement and to feed the oil squirter; and a controller configured to regulate the first switching mechanism.

9. The vehicle according to claim 8, wherein the second switching mechanism is configured as a collapsible lifter.

10. The vehicle according to claim 8, wherein the second switching mechanism is configured as a lockable rocker-arm arrangement.

11. The vehicle according to claim 8, wherein the first switching mechanism is configured as a solenoid oil-control valve.

12. The vehicle according to claim 8, wherein the controller additionally regulates the mixture of fuel and air delivered to the cylinder when the first switching mechanism directs the pressurized oil to the oil squirter, and ceases delivery of the mixture of fuel and air to the cylinder when the first switching mechanism directs the pressurized oil to the second switching mechanism.

13. The vehicle according to claim 8, wherein the cylinder is defined by a cylinder bore, the cylinder includes a piston configured to reciprocate inside the cylinder bore, and wherein the oil squirter is configured to spray the pressurized oil onto at least one of the cylinder bore and the underside of the piston.

14. A method of controlling operation of an internal combustion engine in a vehicle, the method comprising:

pressurizing oil via a fluid pump;

operating a valve arrangement to deliver at least one of the air and a mixture of fuel and air to a cylinder of the engine for combustion therein and exhaust post-combustion gases therefrom;

directing via a first switching mechanism at least a portion of the pressurized oil to feed an oil squirter configured to spray the pressurized oil into the engine cylinder while the mixture of fuel and air is being delivered to the engine cylinder; and directing via the first switching mechanism the at least a portion of the pressurized oil to a second switching mechanism such that operation of the valve arrangement is deactivated while ceasing to direct the at least a portion of the pressurized oil to the oil squirter.

15. The method according to claim 14, wherein the second switching mechanism is configured as a collapsible lifter.

16. The method according to claim 14, wherein the second switching mechanism is configured as a lockable rocker-arm arrangement.

17. The method according to claim 14, wherein the first switching mechanism is configured as a solenoid oil-control valve.

18. The method according to claim 14, further comprising:

regulating the mixture of fuel and air delivered to the cylinder while the pressurized oil is being directed to the oil squirter; and ceasing delivery of the mixture of fuel and air to the cylinder while the pressurized oil is being directed to the second switching mechanism.

19. The method according to claim 18, wherein the vehicle includes a controller, and wherein each of said directing via a first switching mechanism, regulating the mixture of fuel and air, and ceasing delivery of the mixture of fuel and air is accomplished by the controller.

20. The method according to claim 14, wherein the cylinder is defined by a cylinder bore, the cylinder includes a piston configured to reciprocate inside the cylinder bore, and wherein the oil squirter is configured to spray the pressurized oil onto at least one of the cylinder bore and the underside of the piston.

* * * * *